US009715868B2

(12) United States Patent
Brzykcy

(10) Patent No.: US 9,715,868 B2
(45) Date of Patent: Jul. 25, 2017

(54) SYSTEMS AND METHODS FOR MULTI-PANELED PICKGUARD WITH SWITCHBOARD MODULE

(71) Applicant: Stephen J. Brzykcy, Harwood, MD (US)

(72) Inventor: Stephen J. Brzykcy, Harwood, MD (US)

( * ) Notice: Subject to any disclaimer, the term of this patent is extended or adjusted under 35 U.S.C. 154(b) by 0 days.

(21) Appl. No.: 15/283,960

(22) Filed: Oct. 3, 2016

(65) Prior Publication Data

US 2017/0098437 A1 Apr. 6, 2017

Related U.S. Application Data

(60) Provisional application No. 62/236,290, filed on Oct. 2, 2015, provisional application No. 62/402,274, filed on Sep. 30, 2016.

(51) Int. Cl.

| | |
|---|---|
| ***G10D 3/18*** | (2006.01) |
| ***G10D 1/08*** | (2006.01) |
| ***G10H 3/18*** | (2006.01) |

(52) U.S. Cl.

CPC ..... *G10D 3/18* (2013.01); *G10D 1/085* (2013.01); *G10H 3/181* (2013.01)

(58) Field of Classification Search

CPC ..... G10D 1/085; G10D 3/18; G10H 3/181
USPC ..... 84/267, 290, 291
See application file for complete search history.

(56) References Cited

U.S. PATENT DOCUMENTS

| | | | | |
|---|---|---|---|---|
| 4,711,149 | A | 12/1987 | Starr | |
| 5,136,919 | A | 8/1992 | Wolstein | |
| 5,767,432 | A * | 6/1998 | Randolph | G10D 1/085 84/267 |
| 6,111,184 | A | 8/2000 | Cloud | |
| 6,253,654 | B1 | 7/2001 | Mercurio | |
| 6,800,800 | B1 | 10/2004 | Giordano | |
| 7,256,343 | B2 | 8/2007 | Brubaker | |
| 7,635,809 | B2 | 12/2009 | Higgs | |
| 8,283,552 | B2 | 10/2012 | Ekstrom | |

(Continued)

OTHER PUBLICATIONS

Published webpage (prior to Oct. 3, 2015): http://shop.fender.com/en-US/electric-guitars/stratocaster/robert-cray-stratocaster/0139100300.html#start=1.

(Continued)

*Primary Examiner* — Kimberly Lockett

(74) *Attorney, Agent, or Firm* — Laubscher, Spendlove & Laubscher, P.C.

(57) ABSTRACT

A multi-panel pickguard for an electric guitar having one or more strings is disclosed herein. The multi-panel pickguard enables a user to access one or more pickups and one or more user controls without removing the strings. The multi-panel pickguard comprises a controller pickguard configured to house one or more sound altering controls. The controller pickguard further includes at least one beveled edge that is beveled in a one direction. The multi-panel pickguard also comprises a pickup pickguard configured to house the one or more pickups. The pickup pickguard also includes at least one beveled edges that are beveled in an equal and opposite direction with respect to the beveled edge of the controller pickguard. The beveled edge of the controller pickguard and the pickup pickguard are configured to overlap with each other.

8 Claims, 8 Drawing Sheets

(56) References Cited

U.S. PATENT DOCUMENTS

| | | | | |
|---|---|---|---|---|
| 8,796,531 | B2 | 8/2014 | Ambrosino | |
| 2002/0152659 | A1* | 10/2002 | Hartill | G09F 7/00 40/661 |

OTHER PUBLICATIONS

Published webpage (prior to Oct. 3, 2015): http://www.musiciansfriend.com/bass/fender-special-edition-deluxe-ash-jazz-bass.
Published webpage (prior to Oct. 3, 2015): http://www.musiciansfriend.com/guitars/fender-special-edition-deluxe-ash-telecaster.
Published webpage (prior to Oct. 3, 2015): http://www.emgpickups.com/accessories/wiring-kits/wiring-kits/1-2-pickup-ppp-wiring-kit.html.
Published webpage (prior to Oct. 3, 2015): http://www.guitar-hub.com/get-to-know.html.
Published webpage (prior to Oct. 3, 2015): https://www.elek-trix.com/collections/elek-trix-for-fender-telecaster-guitars-wiring-kit.
Published webpage (prior to Oct. 3, 2015): http://www.toneshapers.com/wiring-products/toneshaper-nextgen/toneshaper-ng-fits-stratocaster.html#.WMv-vxl6qV4.
Published webpage (prior to Oct. 3, 2015): http://obsidianwire.com/pro-wire-your-strat/.

* cited by examiner

SYSTEMS AND METHODS FOR MULTI-PANELED PICKGUARD WITH SWITCHBOARD MODULE

RELATED APPLICATION INFORMATION

This application claims the benefit of U.S. Provisional Application 62/236,290, filed Oct. 2, 2015, and U.S. Provisional Application 62/402,274, filed Sep. 30, 2016, both of which are hereby incorporated by reference.

TECHNICAL FIELD

The present disclosure relates generally to stringed musical instruments. More particularly, the present disclosure relates to mechanical designs of electric guitars and electrical components therein.

BACKGROUND

With the advent of the electric guitar and the electric bass guitar ("electric guitars") came a variety of new components associated with these instruments, as well as a fundamental change in instrument design. Among the many differences between an electric guitar and the acoustic guitar, the most significant are that electric guitars often have a solid body, as opposed to a hollow body, and they utilize electromagnetic sensors that transform the oscillations of the guitar strings into electrical signals that are processed by an amplifier to produce the sound of the guitar. These electromagnetic sensors are called "magnetic pickups," or "pickups" for short, in the industry. Pickups are located directly beneath the strings on the guitar near where the musician typically plucks or strums the guitar strings. Along with one or more pickups, electric guitars are often equipped with various controls, usually arranged on the front face of the guitar. A tone control potentiometer, volume control potentiometer, and pickup selection switches are among the most prevalent controls on electric guitars.

To accommodate these electrical components on an electric guitar, a cavity is carved out of the solid body of the guitar to create a space for these components. Some electric guitar designs have a cover that is called a "pickguard" to cover the electrical components. The pickguard on some guitar designs, such as the Stratocaster® guitar popularized by Fender® Musical Instruments Corporation, has a dual purpose: the pickguard serves as a protective cover and mounting structure for the pickups and electrical controls, and it also protects the guitar body material from guitar pick impacts that commonly occur during play. To serve this dual purpose, the pickguard is generally made of rigid, inflexible material.

Because the electrical components of the electric guitar serve as the mechanism by which the guitar string oscillation is transformed into amplified sound, they are often a target of experimentation and modification by musicians who wish to alter the sound of the guitar. Because these electrical components are also subject to wear and failure, they are periodically in need of repair. Therefore, pickups and electrical controls are now part of an industry of aftermarket components which are sold to create different sounds from an existing guitar, or as repair parts to replace worn out or broken components. For these reasons, musicians and guitar repair technicians are often in need of accessing the pickups and electrical controls within the guitar body. However, the body style and pickguard designs on some guitars inhibit the quick and easy removal and replacement of these components.

In particular, the Stratocaster®-style guitars have single-panel pickguards that hold both the user controls and the pickups of the electric guitar. Stratocaster®-style pickguards have conventionally been constructed of a single, continuous piece of inflexible material that is mounted by screws to the solid body of the guitar which contains a cavity for these components. The pickups are electrically wired to a pickup switch, which is wired to the volume and tone control potentiometers. The pickups and controls are mounted directly to the pickguard. The volume and tone controls are then wired to an output jack. While this design is very popular, the single panel pickguard design inhibits quick and easy access to the pickups and electrical components. For example, changing pickups or electrical components on the pickguard first requires removing the entire pickguard, which further requires removal of the guitar strings because of the depth of the components and the rigidity of the pickguard material. Removal of the guitar strings takes a significant amount of time because they must be rewound, and then later reinstalled after the pickguard has been replaced.

Furthermore, the wiring between the electrical components attached to the pickguard has conventionally been connected using soldered contacts requiring soldering equipment and skill to be able to remove and replace those electrical components. Because of the heat generated during soldering, those electrical components and other components that are near the heat source are prone to heat degradation. Therefore, musicians who wish to experiment with various electrical components to create different sounds are impeded by these aforementioned difficulties stemming from conventional pickguard designs.

There are several references in the prior art which teach various devices and methods that attempt to improve the ease of access to the electrical components in the single panel pickguards, such as the Stratocaster®-style pickguard that has been described above. One such reference is the docking system disclosed in U.S. Pat. No. 7,538,269 B2 ("Docking system for pickups on electric guitars," Ekstrom), which is incorporated by reference herein. Ekstrom teaches a pickguard system having a slide mount that is directly mounted to the guitar body, and a pickguard assembly that is configured to engage with the slide mount. For removal of the pickguard, the pickguard slides orthogonally away from the strings along the front plane of the guitar. While Ekstrom teaches a Stratocaster®-style guitar design that allows for easy access to the electrical components, it requires that channels be created in the guitar body to allow the electrical components to slide away from the guitar body. This means that musicians must either purchase a guitar having these channels within the guitar body, or that channels be carved into the solid body of their existing electric guitar. Because of the monetary and sentimental value that many musicians have for their guitars, the latter method would be unacceptable.

Another improvement in the prior art is disclosed in U.S. Pat. No. 6,253,654 B1 ("Electric stringed instrument with interchangeable pickup assemblies which connect to electronic components fixed within the guitar body," Mercurio), which is also incorporated by reference herein. Mercurio's disclosure utilizes through-the-body cutouts for the electrical components such that the pickups and controls can be access from the back side of the guitar body, which alleviates the need for removing the strings. However, Mercurio's disclosure has the same disadvantage of Ekstrom's in that the guitar must either be manufactured with the modifications to the guitar body, or an existing guitar be permanently modified by the addition of this cavity.

According at is needed in the industry is an improved method and system for removing the electrical components of electric guitars quickly and easily without having to purchase a guitar that has been manufactured with that capability, or irreversibly modifying the body of an existing guitar. Further, a system that eases the removal and interchangeability of electrical components while requiring less skill and specialized equipment is needed. In particular, an improved method and system is needed for guitars having a single panel pickguard that houses some or all of the electrical components, such as the Stratocaster®-style pickguard.

SUMMARY OF THE DISCLOSURE

Aspects of the present disclosure herein generally relate to an improved method and apparatus for removing the electrical components of electric guitars quickly and easily without having to purchase a guitar that has been manufactured with this preexisting capability or having to irreversibly modify the body of an existing guitar meet this need. In certain aspects, the present disclosure meets the needs of the electric guitar industry for a system that eases the removal and interchangeability of the electrical components on an electric guitar while requiring less skill and specialized equipment in replacing or repairing these components, while also significantly reducing the time and effort that are generally required for these tasks.

A multi-panel pickguard for an electric guitar having one or more strings is disclosed herein. The multi-panel pickguard enables a user to access one or more pickups and one or more user controls without removing the strings. The multi-panel pickguard comprises at least one controller pickguard configured to house one or more sound altering controls. The possibility exists that one could use a combination of separate controller panels, each with its own subset of controls, to comprise the controller pickguard section. The multi-panel pickguard also comprises at least one pickup pickguard configured to house the one or more pickups, with the possibility that multiple panels could comprise the complete pickup pickguard section. The multiple panels further include at least one type of complimentary edge feature for the joining edges of contiguous panels, which comprise: "tongue and groove" style mechanism, complimentary beveled or angled edges, or other complimentary shapes and forms. The edge features of the controller pickguard and the pickup pickguard are configured to overlap with each other.

In some embodiments, the multi-panel pickguard for an electric guitar is configured to have separate switchboard modules coupled to the controller pickguard or the pickup pickguard. The switchboard module, or a combination of modules, are wired to the user controls, the pickups, and an output jack of the electric guitar and serves as a quick disconnect signal routing device. The function of this switchboard module is to accept the electrical signal from one output wire of a pickup and, separately, send it to and accept a return from one or more components in some order, and then to send the final return to the output jack. The switchboard comprises a non-conductive substrate upon which multiple conductive traces are affixed, whereby each trace has at least three connection points. The switchboard module can be freestanding in some embodiments, or attached to another component in others.

The summary above is not intended to describe each illustrated embodiment or every implementation of the present disclosure. The figures and the detailed description that follow more particularly exemplify these embodiments.

BRIEF DESCRIPTION OF THE DRAWINGS

The disclosure can be more completely understood in consideration of the following detailed description of various embodiments of the disclosure, in connection with the accompanying drawings, in which.

Figure 1:
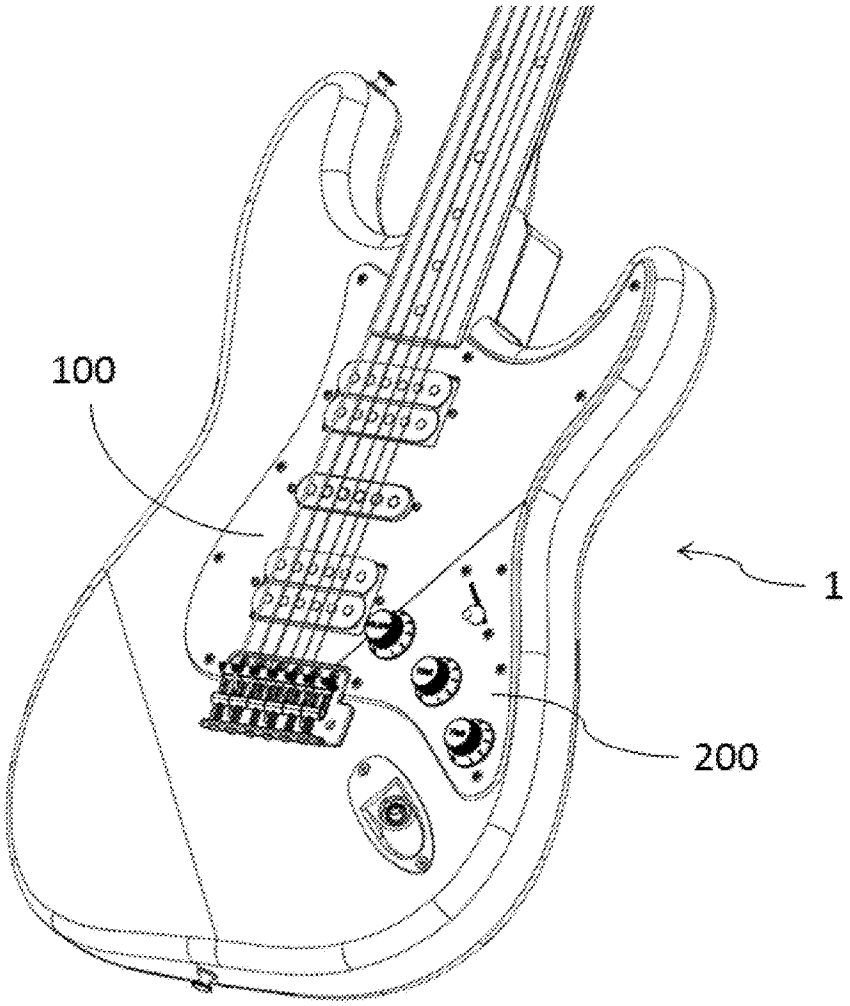
FIG. 1 is an isometric view depicting an electric guitar with a multi-panel pickguard in accordance with an embodiment of the disclosure.

While embodiments of the disclosure are amenable to various modifications and alternative forms, specifics thereof are shown by way of example in the drawings and will be described in detail. It should be understood, however, that the intention is not to limit the disclosure to the particular embodiments described. On the contrary, the intention is to cover all modifications, equivalents, and alternatives falling within the spirit and scope of the disclosure as defined by the appended claims.

DETAILED DESCRIPTION OF THE DRAWINGS

Aspects of the present invention herein generally relate to an improved method and system for removing the electrical components of electric guitars quickly and easily without having to purchase a guitar that has been manufactured with this preexisting capability or having to irreversibly modify the body of an existing guitar meet this need. An example of a modifiable electric guitar is a Stratocaster®-style guitar, and more specifically, an electric guitar having a single panel pickguard that is configured to cover both the controls and the pickups of the electric guitar. One embodiment of the present disclosure provides a mechanism for modifying Stratocaster®-style guitars having single-panel pickguards that hold both the user controls and the pickups of the electric guitar, resulting in two or more separate panels, a pickup panel and a controls panel, each panel capable of being quickly and easily removed from the Stratocaster®-style guitar. These panels have a complementary edge feature that increases the stability of the multi-panel design, helping to limit unwanted flexing or movement of the panels without requiring extra drill holes. The multi-panel pickguard, through its complimentary overlapping edge feature, provides a better solution than that which is offered by existing pickguards. This meets the industry need for a method and system that can be readily applied to an existing Stratocaster®-style guitar, thereby enabling the removal and interchangeability of the electrical components. In addition to enabling the rapid replacement of electrical components under repair conditions as a result of a component failure, this method and system also enables a guitar user to change-out various electrical components for tonal modification, playability, and other reasons that are readily apparent to those skilled in the art of the electric guitar industry.

Figure 2:
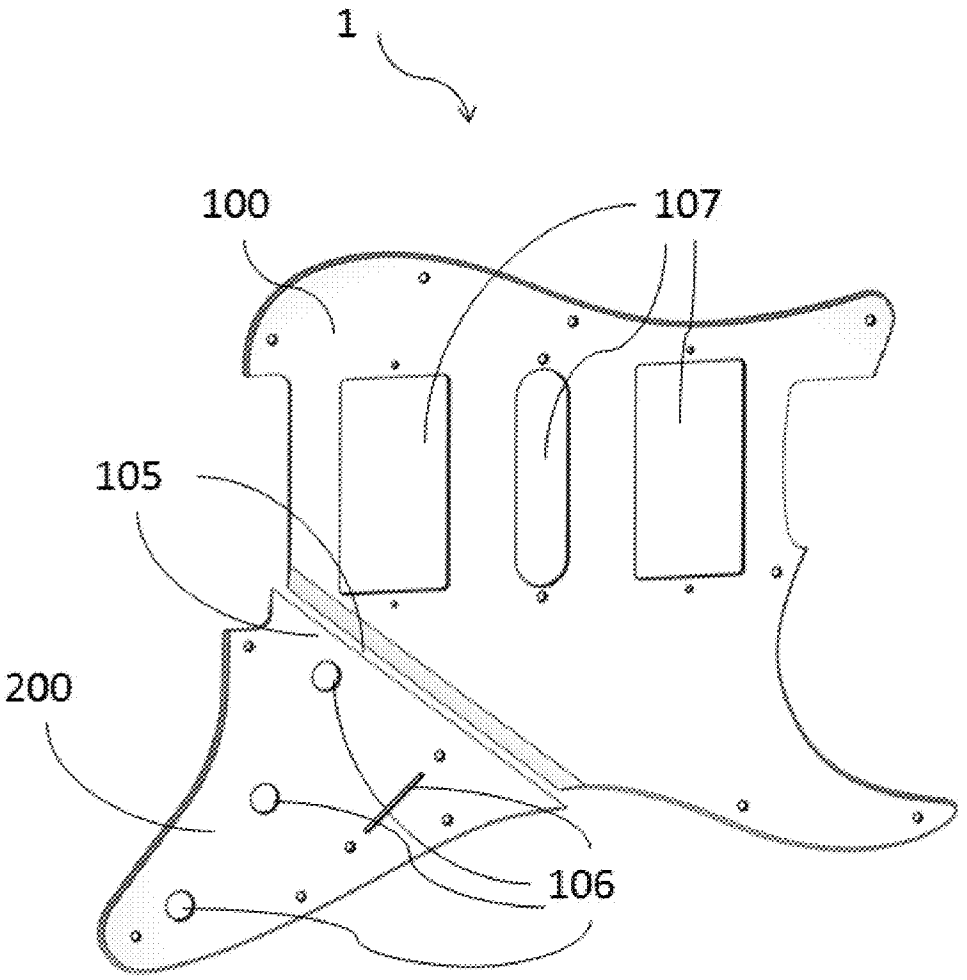
FIG. 2 is an off angle front view depicting a multi-panel pickguard in accordance with an embodiment of the disclosure.
Figure 3A:
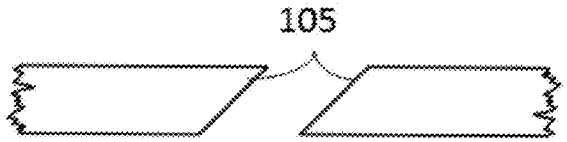
FIGS. 3A-H are cross sectional views depicting various embodiments of joining edges of a multi-panel pickup in accordance with embodiments of the disclosure.
Figure 3B:
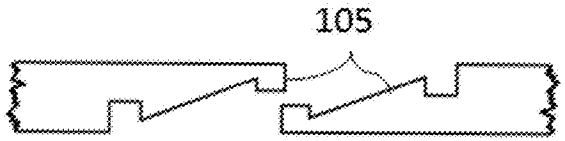
Figure 3C:
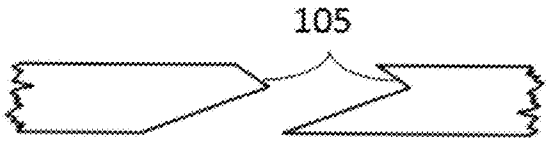
Figure 3D:
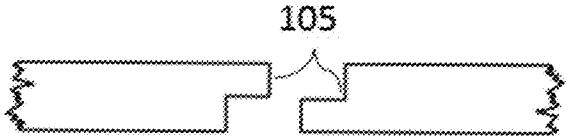
Figure 3E:
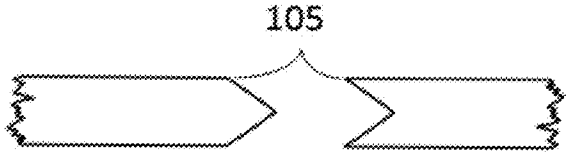
Figure 3F:
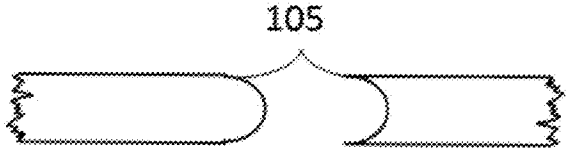
Figure 3G:
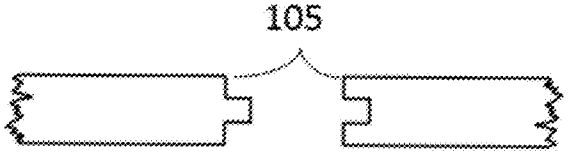
Figure 3H:
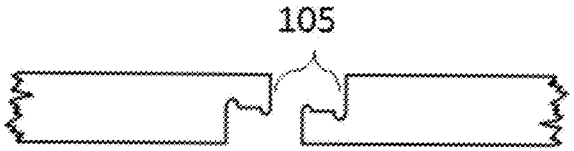

Referring to FIG. 1, a two-panel pickguard 1 is mounted to a Stratocaster®-style guitar. The two-panel pickguard comprises a pickup panel 100 and a controls panel 200. Referring to FIG. 2, pickup panel 100 further comprises a plurality of pickup cutouts 107 which are arranged as necessary, depending on the quantity, size, and location of pickups in the current embodiment. Similarly, controls panel 200 comprises a plurality of controls cutouts 106 which are arranged as necessary, depending on the quantity, size, and location of electrical controls in the current embodiment. Further, controls panel 200 and pickup panel 100 have mating joining edges 105.

In embodiments, joining edges 105 are configured to ensure an overlapping junction that ensures an approximately uniform thickness across the junction. Such a fit is advantageous to ensure that live electrical connections are not easily accessible when pickup panel 100 and controls panel 200 are installed on a guitar. In embodiments, joining edges 105 are configured to have beveled edges to address the aforementioned requirements. For example, joining edges 105 of pickup panel 100 and controls panel 200 can have bevel angles approximately equal and opposite to each other. Specifically, joining edge 105 of pickup panel 100 could have a bevel angle of 45 degrees with respect to the front face of pickup panel 100, and conversely, joining edge 105 of controls panel 200 could have a bevel angle of 135 degrees with respect to the front face of controls panel 200. In alternative embodiments as depicted in FIGS. 3A-H, joining edges 105 could have various edge configurations to accomplish the goal of an overlapping junction that ensures an approximately uniform thickness across the junction. In other embodiments there could be a plurality of complimentary panels, a subset of which would make up the controller portion 200 or pickup portion 100 of the pickguard, implemented to comprise the multi-panel pickguard 1.

Figure 4:
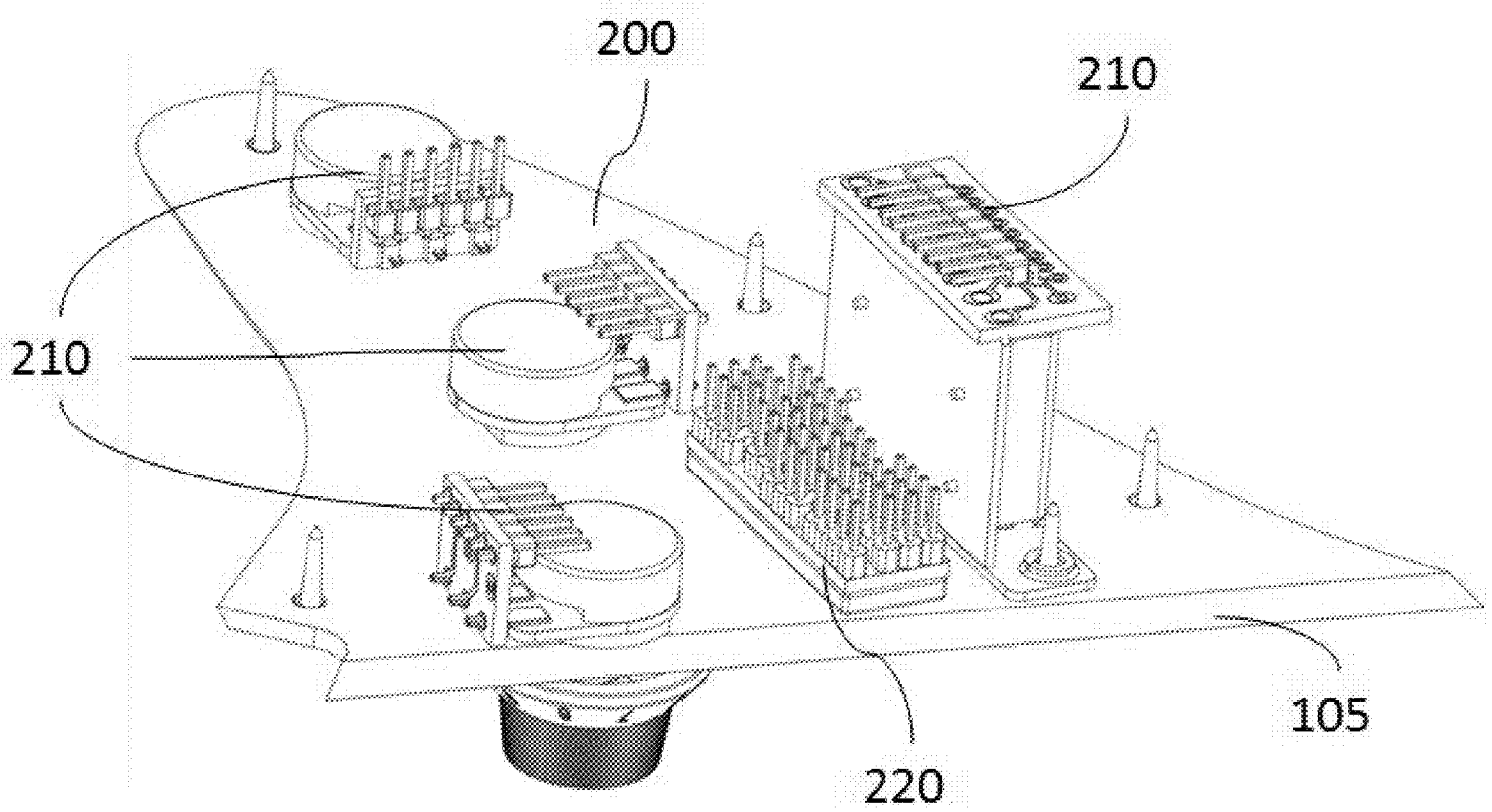
FIG. 4 is an isometric view depicting a controller pickguard in accordance with an embodiment of the disclosure.

Referring to FIG. 4, a bottom view of an embodiment of controls panel 200 is depicted. In embodiments, controls panel 200 provides housing structure for a plurality of sound altering controls 210 mounted using control cutouts 106. In particular, embodiments of controls panel 200 are configured to have a switchboard module 220 coupled to the underside of controls panel 200 using non-conductive putty, or other suitable means for mounting switchboards to flat surfaces. In other embodiments, switchboard module 220 could be coupled to pickup panel 100, or there could be a plurality of switchboard modules 220 configured to couple to pickup panel 100, controls panel 200, or both.

Figure 5A:
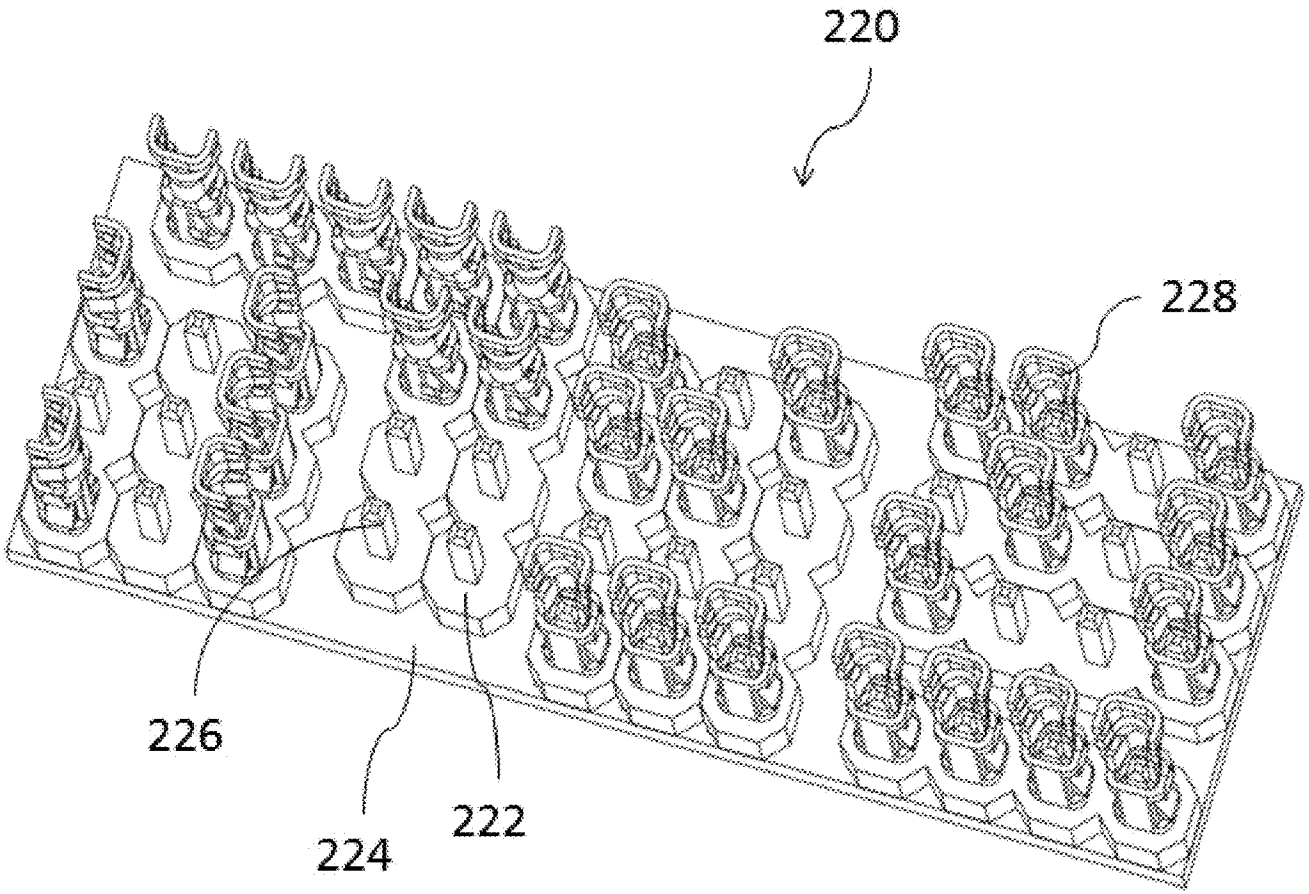
FIGS. 5A-B are isometric views depicting switchboards in accordance with embodiments of the disclosure.
Figure 5B:
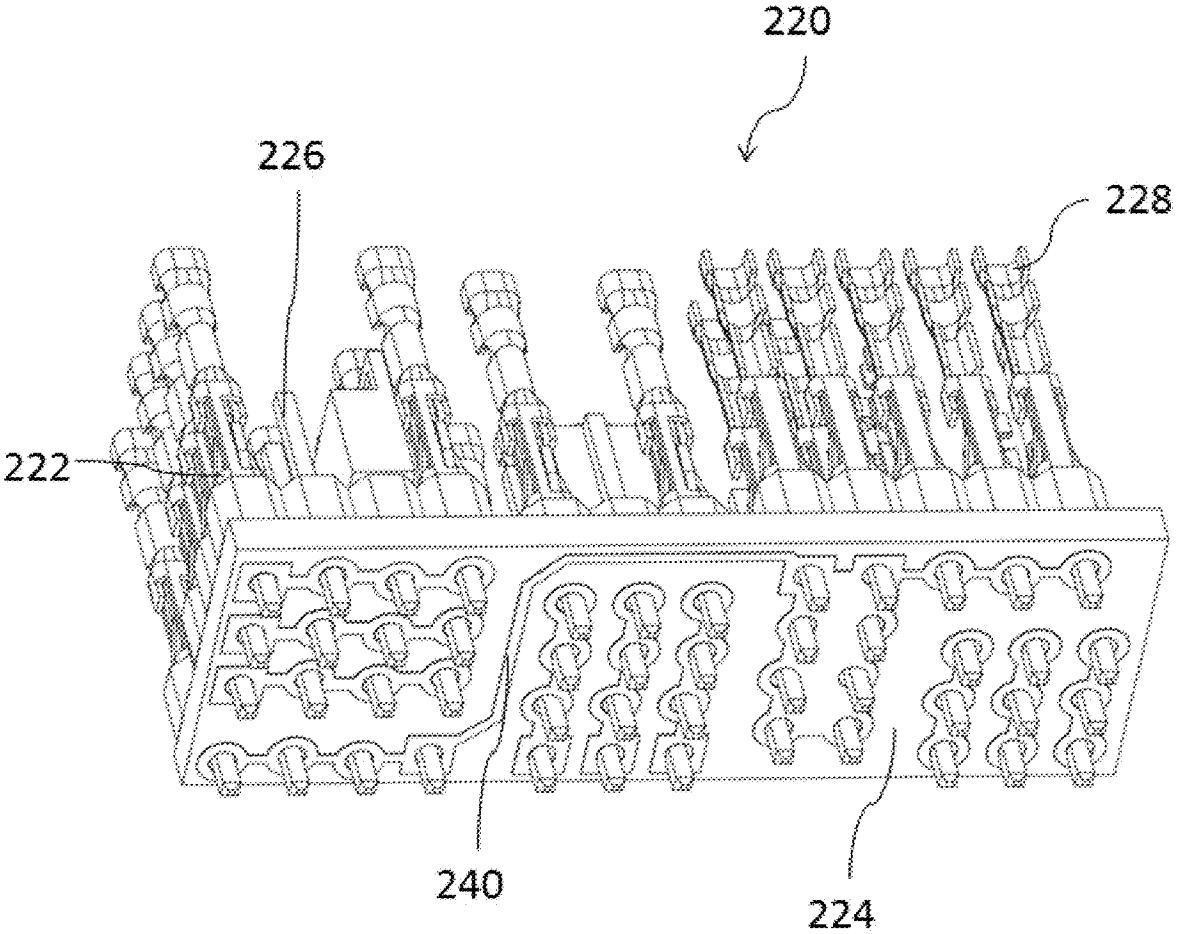

Referring to FIGS. 5A-B, an embodiment of switchboard module 220 is comprised of a plurality of male pin headers 222 and circuit board 224. Male pin header 222 further comprises a plurality of pins 226 selectively arranged on male pin headers 222 and configured to proved a male component to a quick-disconnect type connection. In embodiments, pins 226 are configured to engaged with a female coupling 228. Female coupling 228 engages with pins 226 at one end and is clasped or clamped, such that adequate electrical conductivity is made, around an end of electrical wiring at the second end. The electrical wiring variously leads to all other electrical components of the guitar, e.g. controls 210 or other electrical components.

In embodiments as depicted in FIG. 5B, each pin 226 is electrically connected to a conductive trace pattern 240 applied to circuit board 224. Circuit board 224 is a non-conducting substrate and may be fiberglass or any other material that is generally used, and it contains conductive trace pattern 240 which may be copper or any other conductive material that is generally used. These materials and their manufacturing methods are commonly known by those who are skilled in the arts of the electrical printed circuit board industry. Conductive trace pattern 240 selectively provides connectivity to various male pin headers 222 in a predetermined arrangement.

Figure 6B:
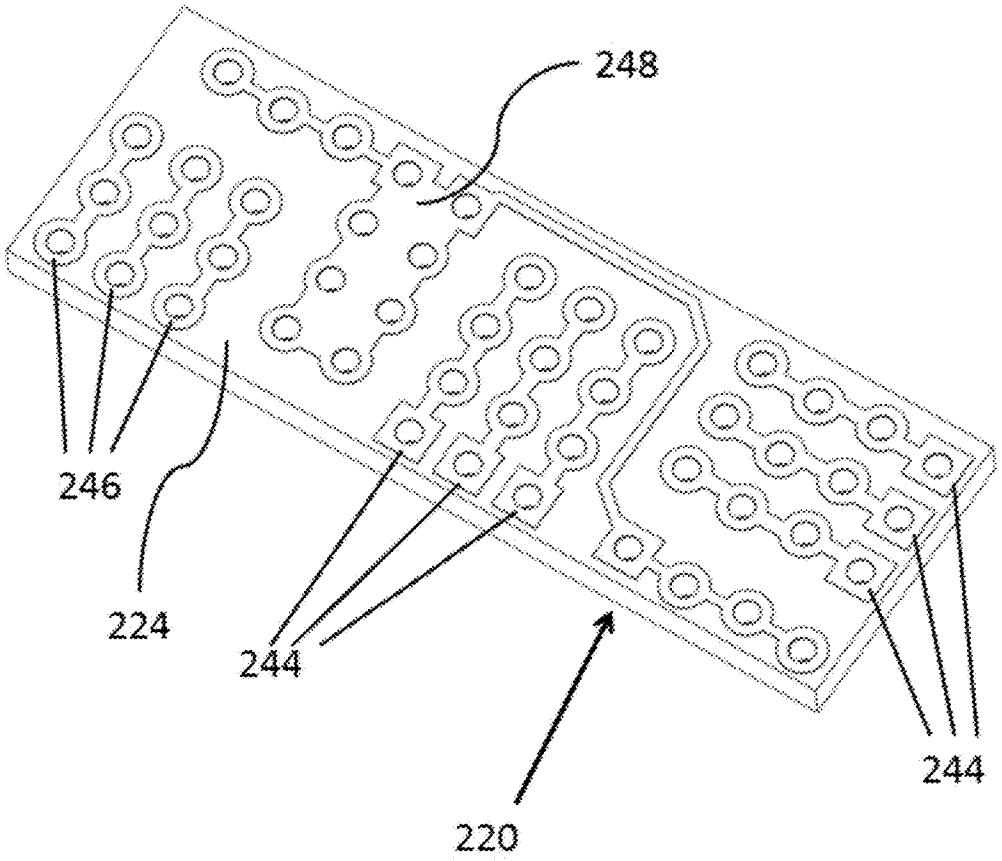
FIGS. 6A-B are isometric views depicting switchboard modules in accordance with embodiments of the disclosure.
Figure 6A:
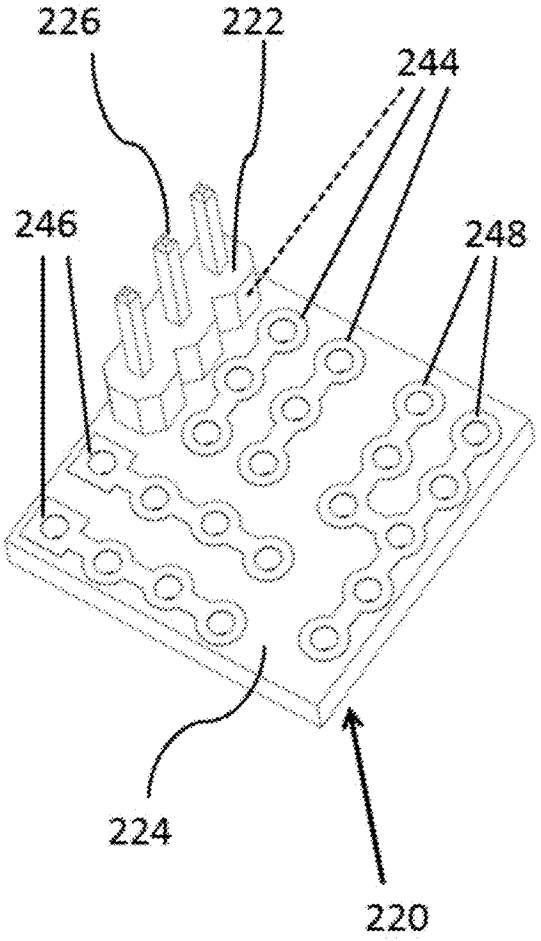
Figure 7:
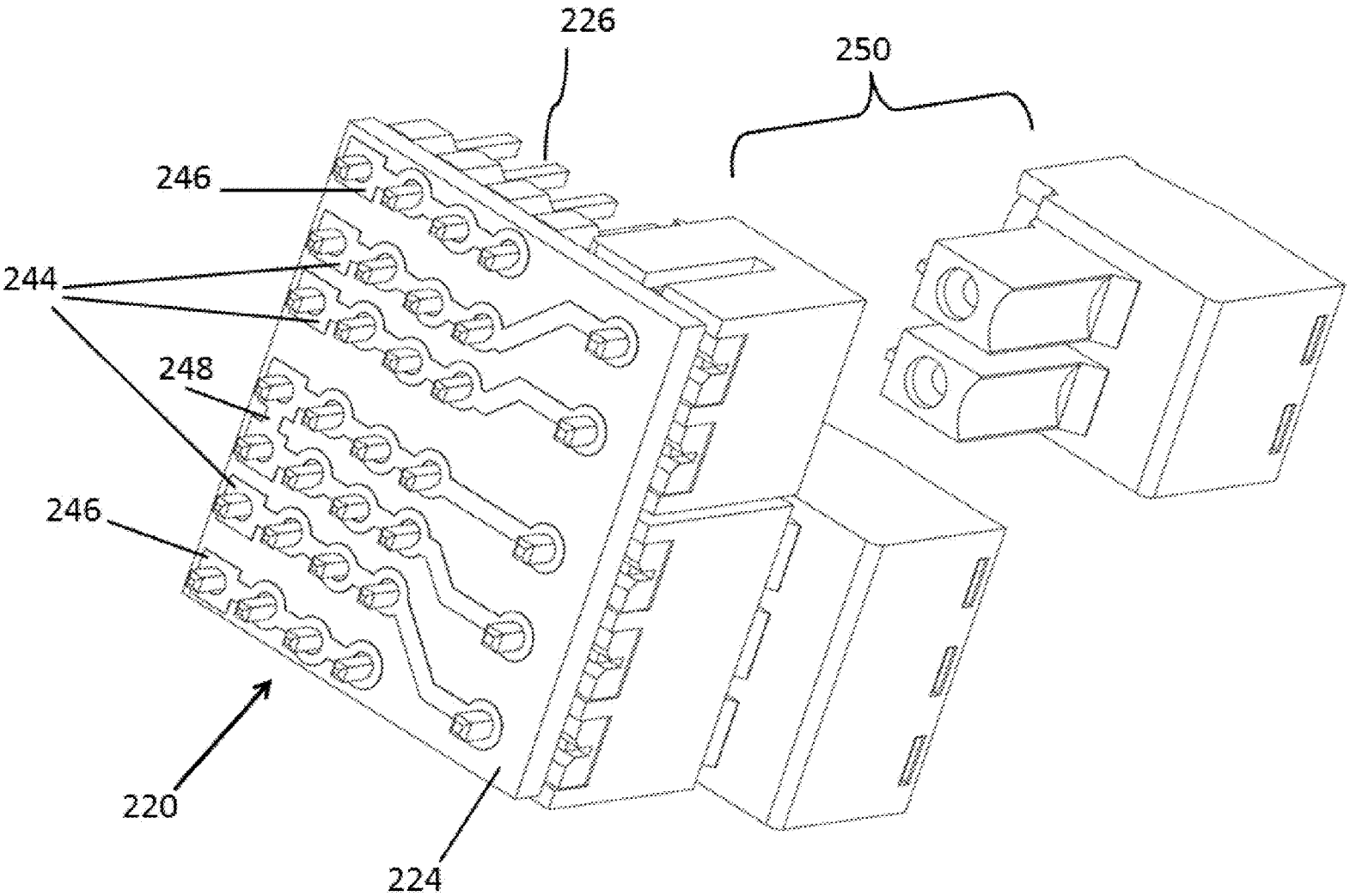
FIG. 7 is an isometric view depicting a switchboard module in accordance with an embodiment of the disclosure.

Referring to FIGS. 6A-B and 7, embodiments of switchboard modules depicting specific pickup and/or component traces 244 and ground traces 248, in conjunction with one or more pluggable terminal block 250 are depicted in accordance with embodiments of the disclosure. The multiple traces on switchboard 220 as shown in FIG. 6B provide the user with the opportunity to route the pickup signal to accommodate most currently used wiring schemes.

In embodiments, the switchboard 220 acts as a quick disconnect intermediary enabling electrical controls that were formerly soldered directly to other electrical components to terminate at switchboard 220, route through switchboard 220 via female coupling 228, pins 226, and conductive trace pattern 240. For example, switchboard 220 could route the electrical input of one of these electrical components through one of pins 226, then through conductive trace pattern 240, and finally through another pin 226, which can be connected to another electrical component via female coupling 228. This functionality allows the user to modify the number and type of electrical components by removing pickup panel 100 or controls panel 200, removing the desired electrical component by detaching it mechanically from the pickup panel 100 or controls panel 200 and removing the accompanying wired female couplings 228 at switchboard 220. The user can then replace the removed electrical component with a different electrical component having wired female couplings 228, then replacing the pickup panel 100 or controls panel 200. In other embodiments the switchboard 220 has female couplings 228 and the wires attach through male pins 226, and further embodiments utilize different quick disconnect connector systems.

In embodiments, each point of electrical contact on conductive trace pattern 240 may be depicted by a letter and number coordinate system or other alternative means of conveying circuit information to the user.

It should be understood that any individual steps used in methods of the present teachings may be performed in any order and/or simultaneously, as long as the teaching remains operable. Furthermore, it should be understood that the apparatus and methods of the present teachings can include any number, or all, of the described embodiments, as long as the teaching remains operable.

Persons of ordinary skill in the relevant arts will recognize that embodiments may comprise fewer features than illustrated in any individual embodiment described above. The embodiments described herein are not meant to be an exhaustive presentation of the ways in which the various features may be combined. Accordingly, the embodiments are not mutually exclusive combinations of features; rather, embodiments can comprise a combination of different individual features selected from different individual embodiments, as understood by persons of ordinary skill in the art. Moreover, elements described with respect to one embodiment can be implemented in other embodiments even when not described in such embodiments unless otherwise noted.

Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended. Furthermore, it is intended also to include features of a claim in any other independent claim even if this claim is not directly made dependent to the independent claim.

Moreover, reference in the specification to "one embodiment," "an embodiment," or "some embodiments" means that a particular feature, structure, or characteristic, described in connection with the embodiment, is included in at least one embodiment of the teaching. The appearances of the phrase "in one embodiment" in various places in the specification are not necessarily all referring to the same embodiment.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims, it is expressly intended that the provisions of Section 112, sixth paragraph of 35 U.S.C. are not to be invoked unless the specific terms "means for" or "step for" are recited in a claim.

What is claimed is:

1. A multi-panel pickguard for an electric guitar having one or more strings, the multi-panel pickguard enabling a user to access one or more pickups and one or more user controls without removing the strings, the multi-panel pickguard comprising:

a controller pickguard configured to house one or more controls, the controller pickguard includes a first set of one or more beveled edges beveled in a first direction, a pickup pickguard configured to house the one or more pickups, the pickup pickguard includes a second set of one or more beveled edges beveled in a second direction, the controller pickguard and the pickup pickguard are configured to be selectively coupled to the electric guitar and arranged to have the first set of one or more beveled edges meet and overlap with the second set of one or more beveled edges.

2. The multi-panel pickguard of claim 1, wherein one or more switchboard modules are coupled to at least one of the controller pickguard and the pickup pickguard, the switchboard module communicatively coupled to the user controls, the pickups, and an output jack of the electric guitar.

3. The multi-panel pickguard of claim 2, wherein each switchboard module comprises a circuit board having at least one circuit trace pattern mounted on a surface thereof.

4. The multi-panel pickguard of claim 3, wherein each switchboard module includes at least one male connector and at least one female connector connected with said at least one circuit trace pattern.

5. The multi-panel pickguard of claim 4, wherein said male connector comprises a pin for plug connection with at a female connector.

6. A multi-panel pickguard for an electric guitar, comprising (a) a controller pickguard for housing one or more user controls, said controller pickguard including a first edge haying a first contoured configuration; and (b) a pickup pickguard for housing one or more pickups, said pickup pickguard including a second edge having a second contoured configuration which is complementary to said first contoured configuration, said controller pickguard and said pickup pickguard being configured for coupling with a body portion of the electric guitar, said first and second edges mating with each other in an overlapping configuration for connection therebetween.

7. A multi-panel pickguard as defined in claim 6, wherein said first and second. contoured configurations comprise at least one of a tongue and groove configuration and a geometric shape.

8. A multi-panel pickguard as defined in claim 7, wherein said geometric shape comprises at least one of an angle, a step, an arrow, a radius of curvature, and a random pattern.

* * * * *